United States Patent [19]

von Hagen

[11] Patent Number: 4,736,696

[45] Date of Patent: Apr. 12, 1988

[54] LOOPER DRIVE WITH SLIDING AND SWIVELING JOINT

[75] Inventor: Wolf-Rudiger von Hagen, Hemmingen, Fed. Rep. of Germany

[73] Assignee: Union Special GmbH, Stuttgart, Fed. Rep. of Germany

[21] Appl. No.: 17,969

[22] Filed: Feb. 24, 1987

[30] Foreign Application Priority Data

Feb. 27, 1986 [DE] Fed. Rep. of Germany ..... 3606285

[51] Int. Cl.[4] ..... D05B 57/02

[52] U.S. Cl. ..... 112/199

[58] Field of Search ..... 112/162, 166, 197, 199

[56] References Cited

U.S. PATENT DOCUMENTS 2,029,233 1/1936 Hacklander ..... 112/199
2,704,042 3/1955 Wallenberg et al. ..... 112/162
3,342,150 9/1967 Tretow et al. ..... 112/162
4,022,140 5/1977 Lienemann ..... 112/199

FOREIGN PATENT DOCUMENTS 976937 12/1964 United Kingdom ..... 112/197

*Primary Examiner*—Wm. Carter Reynolds
*Attorney, Agent, or Firm*—Powell L. Sprunger

[57] ABSTRACT

A looper drive for a chain stitch sewing machine, in which the joint between a connecting rod driven by a main shaft and a lever seated on a swivel shaft is a sliding and swiveling joint. Upon rotation of a ball eccentric, the transverse component of the rotary motion of a spherical shell is enabled by a rod sliding in bearing eyes on a bifurcated lever and the swinging motion of the lever, caused by the longitudinal component of the rotary motion of the spherical shell is enabled by the rod turning in the bearing eyes.

5 Claims, 1 Drawing Sheet

LOOPER DRIVE WITH SLIDING AND SWIVELING JOINT

BACKGROUND OF THE INVENTION

The present invention relates to a looper drive for sewing machines, such as chain stitch sewing machines.

A looper drive is known from German Patent Specification No. 877 536 (FIG. 5) corresponding to U.S. Pat. No. 2,704,042. Such a looper drive has a main shaft with a ball eccentric, a spherical shell surrounding the eccentric and a connecting rod connecting the spherical shell to a lever for imparting a rocking motion to a swivel shaft for driving a looper. In this looper drive, the connecting rod has not only the ball joint connection to the main shaft but also a ball joint connection to the lever on the looper drive shaft. At the ball joint connection to the lever, one degree of freedom is eliminated in that a guide lug prevents the connecting rod from rotating. This necessary restriction of the degree of freedom is structurally complicated and leads to kinematic disadvantages. In high-speed chain stitch sewing machines, these kinematic disadvantages show up in the development of considerable noise.

SUMMARY OF THE INVENTION

A principal feature of the present invention is the provision of an improved looper drive for a chain stitch sewing machine.

The looper drive of the present invention comprises, a main shaft with a ball eccentric, a spherical shell surrounding the eccentric, and a connecting rod connected to the spherical shell and coupled to a lever for imparting a rocking motion to a swivel shaft for driving the looper.

A feature of the invention is that the connecting rod is coupled to the lever by a sliding and swiveling joint.

Another feature of the invention is that a kinematically substantially more advantageous drive is obtained by using a sliding and swiveling joint as the coupling or connection between the connecting rod and the lever.

Yet another feature of the invention is that in the plane of motion perpendicular to the rotational axis of the main shaft, the connecting rod performs a parallel displacement instead of an angular movement. This corresponds to the effect of an infinitely long connecting rod of a crank mechanism, in which no lateral forces occur, with the exception of bearing friction, and, as a result, noise development is considerably reduced.

Further features will become more fully apparent in the following description of the embodiments of this invention and from the appended claims.

DESCRIPTION OF THE PREFERRED EMBODIMENTS

Figure 1:
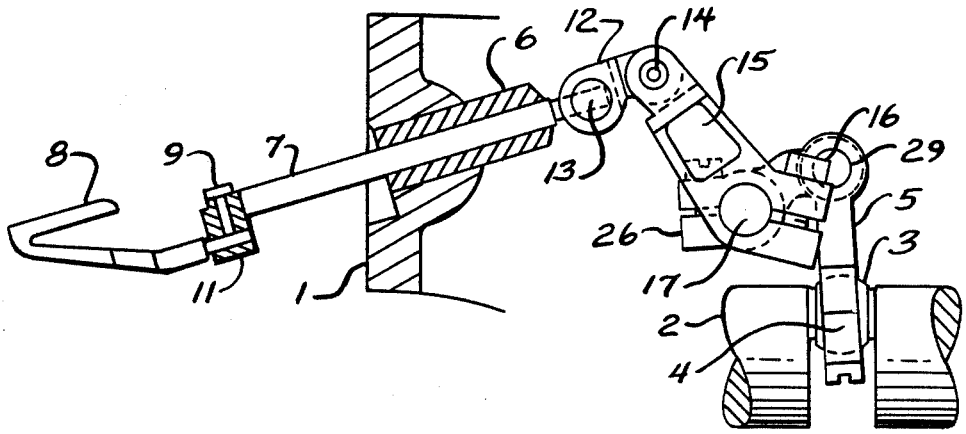
FIG. 1 is a side view, taken partly in section, of a looper drive for a chain stitch sewing machine.
Figure 2:
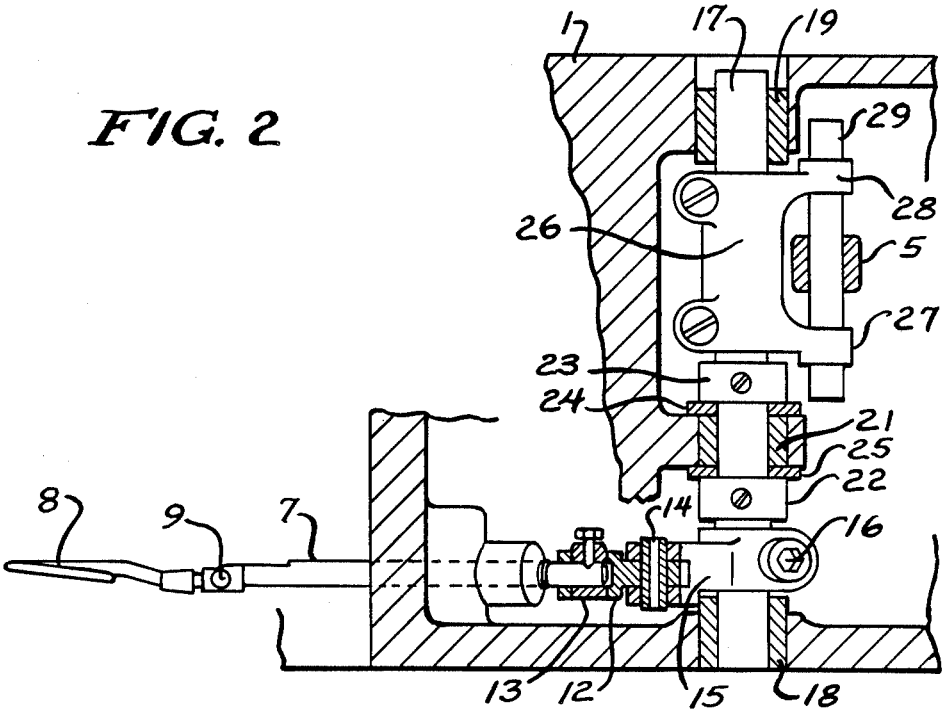
FIG. 2 is a plan view, taken partly in section, of the looper drive of FIG. 1.

Referring now to FIGS. 1 and 2, a looper drive is shown mounted in a housing 1, and which is driven by a main shaft 2 which has a ball eccentric 3. The ball eccentric 3 is surrounded by a spherical shell 4 on one end of a connecting rod 5.

A rod 7 is mounted in a bushing 6 in the housing 1. On its outer end, the rod 7 carries a looper 8 which is secured in a looper holder 11 by a screw 9. The inner end of the rod 7 has a lug 12 which is secured to the rod 7 by a pin 13. A pin 14 connects the lug 12 to a lever 15 which is clamped by a screw 16 onto a swivel shaft 17.

The swivel shaft 17 is mounted in the housing 1 in bushings 18, 19 and 21, and is axially secured by adjustable collars 22 and 23 and washers 24 and 25.

A bifurcated lever 26 with bearing eyes 27 and 28 is also clamped onto the swivel shaft 17. A round bar or rod 29 is axially displaceably and rotatably mounted in the bearing eyes 27 and 28, and, together with the bearings eyes 27 and 28, forms a sliding and swivelling joint. The rod 29 is rigidly connected to the connecting rod 5 between the bearing eyes 27 and 28.

When the main shaft 2 is rotating, the vertical motion of the ball eccentric 3 imparts a rocking motion to the swivel shaft 17. The arcuate movement of the bifurcated lever 26 is enabled by a rotary movement of the rod 29 in the bearing eyes 27 and 28 of the lever 26. The lateral movement of the ball eccentric 3 is enabled by axial displacement of the rod 29 in the bearing eyes 27 and 28 of the bifurcated lever 26, so that the connecting rod 5 undergoes parallel displacement.

The foregoing detailed description is given for clearness of understanding only, and no unnecessary limitations should be understood therefrom, as modifications will be obvious to those skilled in the art.

I claim:

1. A looper drive for a chain stitch sewing machine comprising, a main shaft with a ball eccentric, a spherical shell surrounding the eccentric, and a connecting rod connected to the spherical shell and coupled to a lever for imparting a rocking motion to a swivel shaft for driving the looper, with the connecting rod being coupled to the lever by a sliding and swiveling joint, wherein the connecting rod of the joint is fixedly connected to a round bar which is rotatably and displaceably mounted in bearing eyes on the other part of the joint.

2. The looper drive of claim 1 wherein the round bar is rigidly connected to the connecting rod, and in which the lever forms a fork with the bearing eyes therein.

3. A looper drive for a chain stitch sewing machine, comprising:

a looper;

a swivel shaft;

a lever secured to the swivel shaft;

a main shaft having an eccentric;

a connecting rod;

means for coupling the connecting rod to the eccentric; and means for slidably and swivelably coupling the connecting rod to the lever for imparting a rocking motion to the swivel shaft to drive the looper, wherein the lever has a pair of spaced bearing eyes, including a round bar rotatably and displaceably mounted in the bearing eyes, and in which the connecting rod is fixedly connected to the round bar.

4. The looper drive of claim 3 wherein the eccentric comprises a ball eccentric.

5. The looper drive of claim 4 wherein the first coupling means comprises a spherical shell surrounding the eccentric.

* * * * *